US007306661B2

(12) United States Patent
Rohrbach et al.

(10) Patent No.: US 7,306,661 B2
(45) Date of Patent: Dec. 11, 2007

(54) SERVICE RECORDING DEVICE FOR A FILTER OF AN EXTRACTION HOOD

(75) Inventors: Peter Rohrbach, Königsbach-Stein (DE); Christoph Schmitt, Stein an der Traun (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/858,667

(22) Filed: Jun. 1, 2004

(65) Prior Publication Data

US 2005/0160916 A1 Jul. 28, 2005

Related U.S. Application Data

(63) Continuation of application No. PCT/EP02/12663, filed on Nov. 12, 2002.

(30) Foreign Application Priority Data

Nov. 30, 2001 (DE) ..... 101 58 851

(51) Int. Cl.
*B01D 45/00* (2006.01)

(52) U.S. Cl. ..... 96/418; 96/419; 96/422; 96/424; 55/DIG. 36

(58) Field of Classification Search ..... 96/418, 96/419, 422, 424; 55/DIG. 36
See application file for complete search history.

(56) References Cited

U.S. PATENT DOCUMENTS 6,203,590 B1 * 3/2001 Byrd et al. ..... 55/319

FOREIGN PATENT DOCUMENTS

| | | |
|---|---|---|
| DE | 28 16 406 A1 | 10/1979 |
| DE | 78 13 240 U1 | 10/1979 |
| DE | 28 52 472 A1 | 6/1980 |
| EP | 0 094 360 A1 | 11/1983 |

* cited by examiner

*Primary Examiner*—Robert Hopkins
(74) *Attorney, Agent, or Firm*—Russell W. Warnock; Craig J. Loest; James E. Howard

(57) ABSTRACT

A service recording device for a filter is particularly suited for an extraction hood with an air flow device with a variable volumetric flow. The service recording device has a counter device with a variable counting speed. The counting speed of the air flow device is thus a function of the volumetric flow of the air flow device.

11 Claims, 1 Drawing Sheet

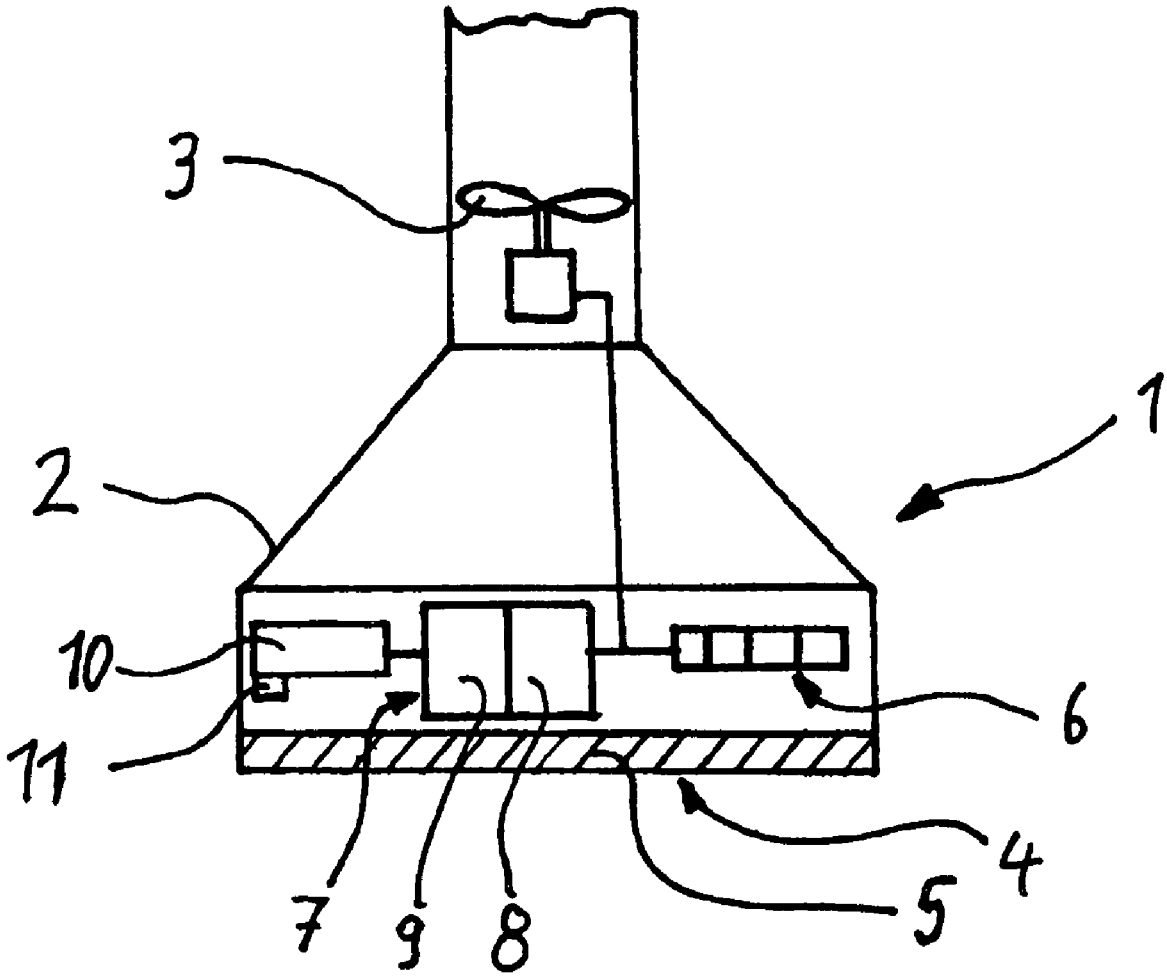
3
1
2
10
6
11
4
7
9
8
5

SERVICE RECORDING DEVICE FOR A FILTER OF AN EXTRACTION HOOD

CROSS-REFERENCE TO RELATED APPLICATION

This application is a continuation, under 35 U.S.C. § 120, of copending international application No. PCT/EP02/12663, filed Nov. 12, 2002, which designated the United States; this application also claims the priority, under 35 U.S.C. § 119, of German patent application No. 101 58 851.8, filed Nov. 30, 2001; the prior applications are herewith incorporated by reference in their entirety.

BACKGROUND OF THE INVENTION

Field of the Invention

The present invention relates to a service recording device for a filter, in particular a filter of an extraction hood, with a air flow device that produces a variable volumetric flow.

German utility model GM 78 13 240 U (Gebrauchsmuster) discloses an extraction hood which has an air flow device controlled by at least one switch and has arranged upstream thereof a grease filter. An indicating device indicates a degree of soiling of the filter. The indicating device has for this purpose a counting mechanism, which advances when a switching-on button of the air flow device is actuated and allows a color marking to become visible in an indicating window when a predetermined counter reading has been reached.

The disadvantage of this arrangement is that neither the duration of the switched-on period nor the power stage in which the air flow device is being operated at the particular time is taken into account in the determination of the degree of soiling of the filter, so that it is only possible for the service life of the filter to be recorded very vaguely.

German published, non-prosecuted patent application DE 28 52 472 shows a device for recording the degree of soiling of an air filter of an extraction hood in which the electric drive current for the blower is converted into a proportional amount of heat and this amount of heat is used to vaporize a liquid. The difference in the liquid level with respect to the starting level serves as a measure of the degree of soiling.

That device is capable of recording the degree of soiling of the filter relatively accurately. However, it is disadvantageous that a certain amount of heat that vaporizes a liquid first has to be generated, the vaporized liquid having to be additionally replenished when the filter is changed, which increases the effort involved in servicing.

European patent application EP 0 094 360 shows an indicating device in an air filter with a fan which is driven by an electric motor and can be operated at different capacities. In order to indicate the degree of soiling of the filter, which is proportional to this capacity of the fan, arranged in the circuit of the electric motor is a resistor which delivers a voltage that produces a current supply in a circuit of an electrolytic cell with a greater voltage drop during discharging than during charging.

That prior art assembly likewise allows a relatively accurate degree of soiling of the filter to be determined, but the assembly is of a very complex construction, since an electrolytic cell, a resistor, etc., are required.

SUMMARY OF THE INVENTION

It is accordingly an object of the invention to provide a service time determination unit for a filter which overcomes the above-mentioned disadvantages of the heretofore-known devices and methods of this general type and which provides for a service recording device for a filter with an air flow device, in particular for an extraction hood, which can accurately record the degree of soiling of the filter by simple means.

With the foregoing and other objects in view there is provided, in accordance with the invention, a service time recording device for a filter, particularly a filter in an extraction hood, with an air flow device having a variable volumetric flow. The recording device comprises:

a counting device with a variable counting speed, the counting speed being a function of the volumetric flow of the air flow device.

The fact that the service recording device for a filter, in particular for an extraction hood, with an air flow device with a variable volumetric flow, has a counting device with a variable counting speed, and the counting speed is a function of the volumetric flow of the air flow device, allows the service life of the filter to be calculated by integration or addition by simple means. As a result, the point in time of the saturation of the filter can be accurately determined in dependence on the volumetric flow at the particular time and the switched-on period. Furthermore, a demand-specific depletion indication of the filter is achieved, it generally being possible for the routine intervals at which the filter is changed to be extended. The implementation of the service recording device can be accomplished in a simple and low-cost way by integrating additional functions in existing control devices.

In an advantageous refinement of the service recording device, the counting speed of the counting device is directly proportional to the volumetric flow, the counting speed increasing with increasing volumetric flow and decreasing with decreasing volumetric flow. As a result, an exact depletion indication of the filter in dependence on the air throughput through the filter is achieved.

In a further advantageous refinement of the service recording device, the counting device generates a signal for the end of the service life of the filter when a predetermined counting value is reached, it being possible for the signal to be an optical signal and/or an acoustic signal.

In a further advantageous configuration of the service recording device, the air flow device can be operated in various power stages, each power stage being assigned a predetermined target speed.

With this configuration it is possible to provide a service recording device in which the air flow device is not operated infinitely variably but in power stages.

With the above and other objects in view there is also provided, in accordance with the invention, an extraction hood, comprising:

an air flow device configured to extract air at a variable volumetric flow;

a filter for filtering the air being pumped by the air flow device; and a filter service recording device for recording a service life of the filter, the recording device including a counter configured to count volume units of the volumetric flow through the filter.

In accordance with a concomitant feature of the invention, the apparatus further includes a switching device for switching the air flow device and setting the volumetric flow through the filter, the counter being connected to the switching device and counting the volume units in accordance with a setting of the switching device.

Other features which are considered as characteristic for the invention are set forth in the appended claims.

Although the invention is illustrated and described herein as embodied in a service recording device for a filter of an extraction hood, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE of the drawing shows a service recording device for a filter in an extraction hood.

DESCRIPTION OF THE PREFERRED EMBODIMENTS

Referring now to the figure of the drawing in detail, there is shown an extraction hood 1 with a housing 2, in which an air flow device 3 is disposed. A filter 5, which cleanses the air sucked in via the filter 5 by means of the air flow device 3 of particles, grease and/or odors, is provided in an intake opening 4 of the housing 2. A grease filter, for example made of expanded metal or nonwoven fabric or paper, and/or an activated carbon filter or the like may be provided as the filter 5.

The air flow device 3 is switched on and controlled by way of input buttons 6. It is possible, by actuating different buttons, for different power stages or volumetric flows to be switched. Preferably, three power stages are provided, a low power stage, a medium power stage, and a high power stage.

A control device 7 is electrically connected to the input buttons 6. The control device 7 comprises a counting device 8 and a timing element 9. Electrically connected to the control device 7 is an optical indicating device 10 and a buzzer 11, which may also be formed as a loudspeaker.

If for example the air flow device 3 is operated by way of the input buttons 6 in the low power stage, after the elapse of a predetermined time interval $\Delta t1$ the counting device is incremented by the amount 1. If the air flow device 3 is operated in the medium stage, after the elapse of a time interval $\Delta t2$ the counting device is incremented by 1. If the air flow device 3 is operated in the high power stage, after the elapse of a time interval $\Delta t3$ the counting device 8 is incremented by 1. The time intervals $\Delta t1$, $\Delta t2$ and $\Delta t3$ are in this case determined in such a way that, once a predetermined amount of air has flowed through the filter 5 in dependence on the chosen power stage of the air flow device 3, the counting device is incremented by one unit. In this case, the relationship between the time intervals $\Delta t1$ to $\Delta t3$ is $\Delta t1 > \Delta t2 > \Delta t3$.

In this way, the counting speed of the counting device is a function of the volumetric flow of the air flow device 3 in such a way that the counting speed of the counting device is directly proportional to the volumetric flow, the counting speed increasing with increasing volumetric flow and decreasing with decreasing volumetric flow.

Once the counting device 8 has reached a predetermined counting value, a signal for the end of the service life of the filter 5 is emitted to the optical indicating device 10 and/or the buzzer 11. After exchanging the filter, the counting device can be reset by way of a non-illustrated switch, which is preferably disposed in the interior of the housing 2.

Instead of operating the air flow device 3 in different power stages—as described above—the air flow device may also be set infinitely variably from a minimum power stage to a maximum power stage, for example by way of a sliding controller. The speed of the counting device is then controlled in proportion to the volumetric flow of the air flow device that is set at the particular time.

We claim:

1. In a filter assembly for a home applliance with an air flow device having a variable volumetric flow rate and an assembly for controlling the volumetric flow rate, a service recording device, comprising:

a counting device for counting volume units of flow through the filter, said counting device having a variable incrementation rate, said incrementation rate being variable based on a setting of said assembly for controlling the volumetric flow rate of the air flow device as the air flow device extracts air at a variable volumetric flow rate relative to a surface of a household appliance such that at least one of particles, grease, odors, or other substances are entrained with the flow of air for removal therefrom by the filter assembly.

2. The service recording device according to claim 1 disposed in an extraction hood.

3. The service recording device according to claim 1, wherein the incrementation rate of said counting device increases with increasing volumetric flow rate and decreases with decreasing volumetric flow rate.

4. The service recording device according to claim 1, wherein said counting device is configured to generate a signal for an end of the service life of the filter when a predetermined counting value of said counting device is reached.

5. The service recording device according to claim 4, wherein the signal is at least one of an optical signal and an acoustic signal.

6. The service recording device according to claim 1, wherein the air flow device is operable in various power stages, and each power stage is assigned a predetermined time interval for incrementing said counting device.

7. An extraction hood for a household appliance, comprising:

an air flow device configured to extract air at a variable volumetric flow rate relative to a surface of a household appliance such that at least one of particles, grease, odors, or other substances are entrained with the flow of air;

a filter for filtering the air being extracted by said air flow device; and a filter service recording device for recording a service life of said filter, said recording device including a counter configured to count volume units of the volumetric flow through said filter.

8. The extraction hood according to claim 7, which further comprises a switching device for controlling said air flow device and setting the volumetric flow rate through said filter, said counter being connected to said switching device for counting the volume units in accordance with a setting of said switching device.

9. An extraction hood for a household appliance, the extraction hood comprising:

an air flow device configured to extract air at a variable volumetric flow rate relative to a surface of the household appliance such that at least one of particles, grease, odors, or other substances are entrained with the flow of air;

a filter for filtering the air being extracted by said air flow device to thereby remove from the air at least one of the particles, grease, odors, or other substances that have been entrained with the flow of air;

a filter service recording device for recording a service life of said filter, said recording device including a counter configured to count volume units of the flow through said filter; and a switching device for switching said air flow device and setting the volumetric flow rate through said filter at a selected one of a plurality of discrete power stages, each of said discrete power stages providing a volumetric flow rate of air through said filter that is different than the respective volumetric flow rates of air through said filter at the other ones of said discrete power stages, said counter being connected to said switching device and counting the volume units indicating the respective volumetric flow of air in accordance with a setting of said switching device at each respective discrete power stage.

10. The extraction hood according to claim 9, wherein said counter increments, by a predetermined incrementing unit, the amount of the volume units thereby indicating the respective volumetric flow of air each time a predetermined amount of air has flowed through said filter during each respective discrete power stage and the time interval at which said counting device increments the count of the volume units by a predetermined incrementing unit is respectively different for each one of said discrete power stages, whereupon the incrementation rate of said counter increases when a respective one of said discrete power stages is selected wherein a relatively greater volumetric flow of air is extracted through said filter than was extracted during a preceding one of said discrete power stages and whereupon the incrementation rate of said counter decreases when a respective one of said discrete power stages is selected that extracts a relatively lesser volumetric flow of air through said filter than was extracted during a preceding one of said discrete power stages.

11. The extraction hood according to claim 9, wherein said switching device includes a plurality of input elements each for individual actuation by a user to respectively select a selected one of said plurality of discrete power stages effecting a volumetric flow of air through said filter.

* * * * *